United States Patent [19]

Remys et al.

[11] 4,209,968

[45] Jul. 1, 1980

[54] CLOCK CHIME WITH SHUTOFF

[75] Inventors: Dionizas V. Remys, Clarendon Hills; Donald R. Scott, Lombard, both of Ill.

[73] Assignee: Sunbeam Corporation, Chicago, Ill.

[21] Appl. No.: 812,219

[22] Filed: Jul. 1, 1977

[51] Int. Cl.[2] ..... G04B 21/10

[52] U.S. Cl. ..... 368/273; 368/262

[58] Field of Search ..... 58/8, 9, 10, 11, 12, 58/13, 38 R, 38 A, 21.15

[56] References Cited

U.S. PATENT DOCUMENTS

| | | | |
|---|---|---|---|
| 1,001,095 | 8/1911 | Towns | 58/8 |
| 1,103,453 | 4/1914 | Treganza | 58/21.15 |
| 1,304,924 | 5/1919 | Wehinger | 368/273 |
| 2,020,388 | 11/1935 | Watson | 58/21.25 |
| 2,127,635 | 8/1938 | Warshawsky | 368/270 |
| 2,779,151 | 1/1957 | Fowler | 368/273 |
| 4,020,625 | 5/1977 | Mahon et al. | 368/100 |

*Primary Examiner*—Joseph V. Truhe
*Assistant Examiner*—L. W. Pojunas, Jr.
*Attorney, Agent, or Firm*—George R. Clark; Neil M. Rose; Clifford A. Dean

[57] ABSTRACT

In a clock having a synchronous motor and a chime that is struck once evey half hour by a biased hammer assembly that is prevented from striking the chime except when a tab on the hammer falls into a notch on a wheel driven by the minute shaft, a chime shutoff is mounted on the back cover of the clock for movement between a chime "on" and a chime "off" position.

3 Claims, 3 Drawing Figures

10
11
59
53
59
51
15
52
26
54
27
47
44
49
56
56
46
28
45
37
30
39
33
33
40
59
59
25

CLOCK CHIME WITH SHUTOFF

BACKGROUND OF THE INVENTION

In the clock art it has been well known to provide sound producing means associated with the clock motor and movement, either for the purpose of signalling a preselected time for awakening or the like or for regularly sounding the half hour or hour. Particularly in such prior art devices that function as alarm clocks, some means of shutting off the sound producing means has also been provided such as in Richmond U.S. Pat. No. 3,485,031. Although not as common in the clocks which sound the half hour and/or the hour, some of those prior art clock movements such as Wehinger U.S. Pat. No. 1,300,309 have been provided with chime shutoff means.

The prior art sound shutoff means, particularly those for clocks which regularly sound the half hour and/or hour, are complex and expensive to manufacture. Usually, the purchaser of a clock which regularly sounds the half hour and/or the hour has selected such a clock because he finds the ringing or chiming sound to be pleasant and is not desirous of shutting it off. There are, however, times such as when someone in the family is ill or perhaps there is an overnight guest that it becomes highly desirable to shut off or silence the regular interval sound-producing means. While such a feature may be desirable at such times, the purchaser of such clocks is not willing to expend a large amount of money for such an additional feature.

SUMMARY OF THE INVENTION

The present invention is concerned with a simple and inexpensive but yet effective shutoff for a clock chime. A clock movement mounted through an open back of a clock housing has a means for regularly sounding a chime carried on the back plate of the clock movement. It is generally necessary in such clocks to provide a rear cover for the housing to protect the movement against damage. The chime is sounded at regular intervals by means of a spring biased hammer striking a steel coil chime. A pin for restraining the hammer from contact with the chime coil is carried by a slot in the cover member. The slot is provided with cam surfaces for maintaining the pin in the preselected chime on or chime off position.

Accordingly, it is an object of the present invention to provide a simple and inexpensive means for shutting off a regularly sounding clock chime.

It is a further object of the present invention to provide a clock chime shutoff means that is carried by a rear cover member such that it need not be an integral part of the clock movement.

Further objects and advantages of the present invention will become apparent as the following description proceeds, and the features of novelty which characterize the invention will be particularly pointed out in the claims annexed to and forming a part of the specification.

BRIEF DESCRIPTION OF THE DRAWINGS

For a better understanding of the present invention, reference may be had to the accompanying drawings in which.

DESCRIPTION OF THE PREFERRED EMBODIMENT

Figure 1:
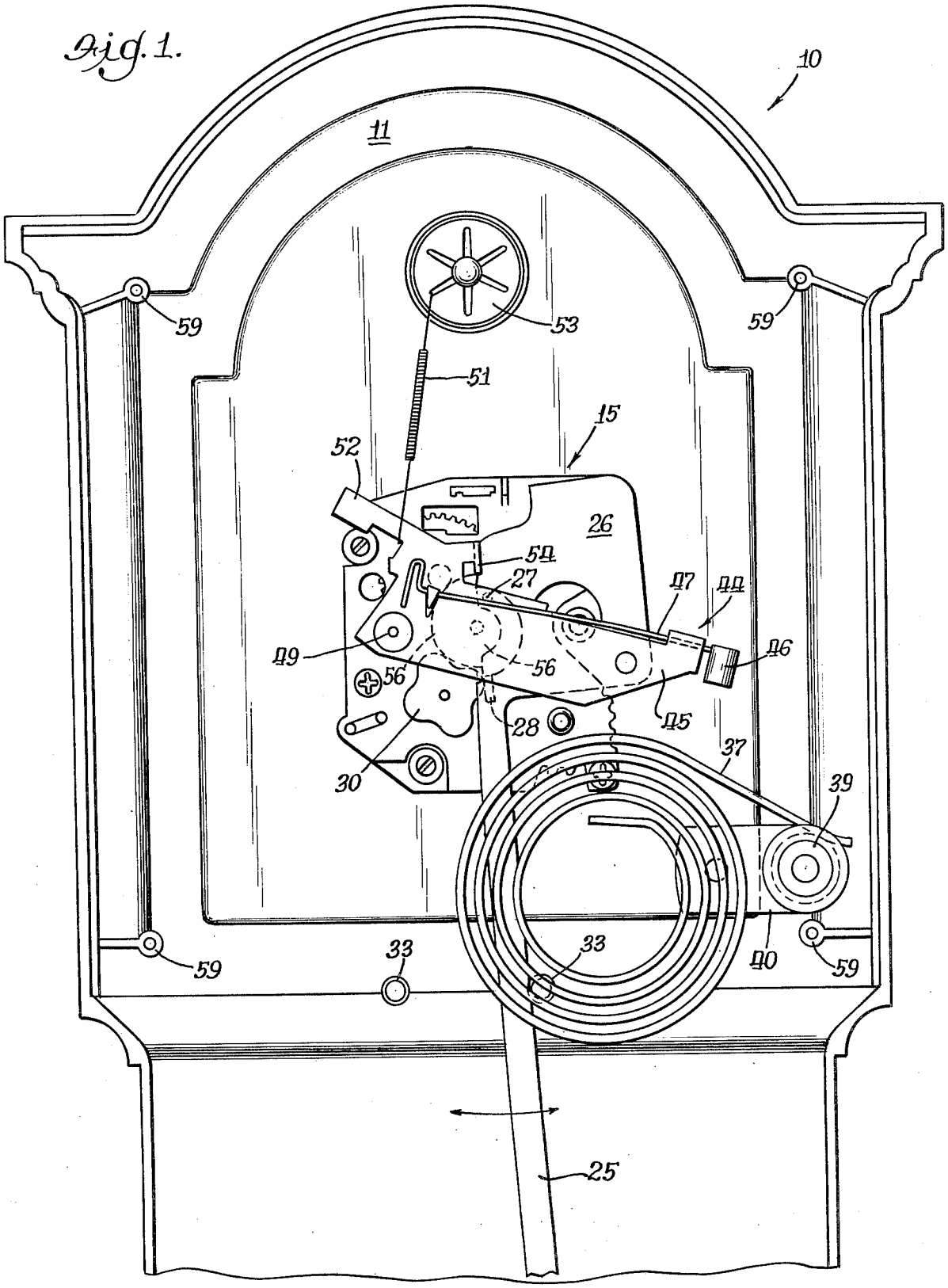
FIG. 1 is a partial view of the back of a clock, the cover member of which has been removed, showing the clock movement with a pendulum and chime.

Referring now to the drawings in which like parts are designated by like reference numerals in the various views, there is shown in FIG. 1 a portion of a clock having a pendulum and chime movement. The clock 10 comprises a housing 11 of any desirable esthetic design. An open back is provided on the housing for mounting the clock movement 15.

The basic movement contained between front plate 16 and back plate 17 is very similar to that disclosed in Jepson et al U.S. Pat. No. 3,498,048, so it will not be described in any great detail herein. The hour hand 20 and minute hand 21 are driven by means of shafts extending through the dial face 22 of the clock.

The pendulum has an arm 25 formed with an upper eccentric weight portion 26. Arm 25 is pivotally mounted on the rear plate 17 of the movement on axis 27. As will be best seen in FIG. 2, the eccentric weight portion 26 is spaced away from the rear plate 17. A projection 28 is provided on the eccentric weight portion 26 which extends toward the rear plate 17. A four-lobed cam 30 is mounted on a shaft 31 and is drive through intermediary gearing of the clock motor movement. The rotation of the pendulum arm 25 about the axis 27 resulting from the projection 28 riding on the four-lobed cam 30 produces a simulated pendulum motion at the lower end of the arm which carries a pendulum bob not shown in the drawings. The clock housing may be provided with bosses 33 which limit the movement of the pendulum arm 25.

The chime comprises a chime coil 37 which is mounted on a post 39 that is in turn secured to the clock housing by means of a mounting plate 40. A hammer assembly 42 for sounding the chime is carried by the back plate 17 of the movement 15. Pivoted lever 45 has a slug of metal or hammer head 46 mounted on the lever 45 by an elongated spring 47. The lever 45 is pivotally mounted on the back plate 17 by means of shaft 49 such that the hammer head 46 is biased by gravity into contact with the chime coil 37. An additional biasing force for bringing the hammer head 46 into contact with the chime coil 37 is provided by means of a coil spring 51 which is attached at one end to a rearwardly projecting arm 52 on the lever 45. The other end of the coil spring 51 is affixed to a stationary part of the clock housing such as the star-shaped clip 53.

Figure 3:
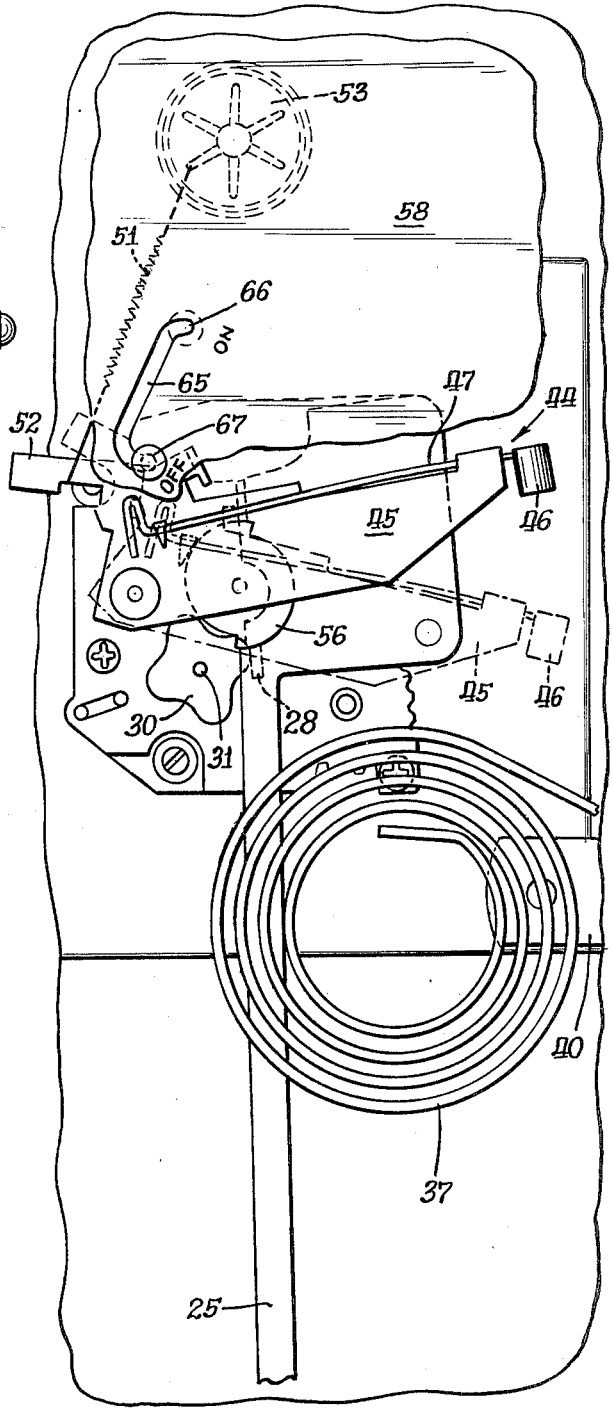
FIG. 3 is a fragmentary view of the clock shown in FIG. 1, some portions of the movement having been omitted, showing a portion of the rear cover member and the clock chime shutoff.

The pivoted lever 45 has a tab 54 that is in contact with the notched wheel 56. As will be appreciated from FIGS. 1 and 3, particularly FIG. 3 which shows the hammer assembly locked from sounding the chime as well as in chime-striking position in broken line, when the tab 54 is biased against the high portions of the notched wheel 56 the pivoted lever 45 cannot strike the chime coil 37. However, when the tab 54 drops into either one of the notches on the wheel 56 the hammer can then strike and sound the chime coil 37. In the preferred embodiment the two notch wheel 56 is mounted on the hour hand shaft such that the hammer assembly 44 strikes the chime every half hour. By either varying the speed of rotation of the wheel 56 or by providing it with more or less notches different patterns chime sounds can be obtained.

Figure 2:
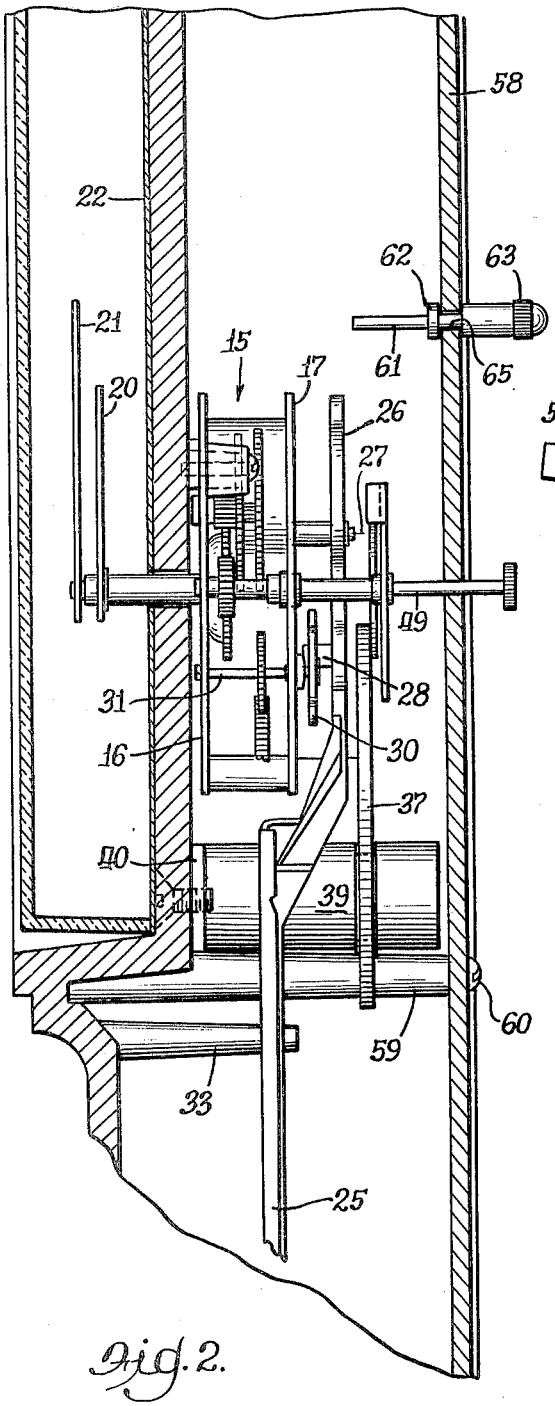
FIG. 2 is a partial vertical sectional view of the clock shown in FIG. 1.

The clock housing 11 is normally provided with a cover 60 which serves to protect the clock movement including the pendulum and chime portions from damage. In the present invention the cover also carries a chime shutoff pin 61 which comprises a shouldered shaft 62 and a knob 63. As is best shown in FIG. 2 when the knob is attached to the shaft 62 the shutoff pin assembly is trapped on the cover 60. The pin 61 is movable in a slot 65 provided on the cover. The fit between the pin 61 and the slot 65 can be made quite close such that in order to move the pin within the slot it is necessary to rotate the knob 63. The slot is provided with a cam portion at each of its extremeties. When the pin 61 is in the uppermost end 66 of the slot 65, as shown in FIG. 2, it is completely out of the way of the hammer assembly 44. Thus, the hammer assembly is restrained from sounding the chime only by means of tab 54 cooperating with notched wheel 56. However, when the pin 61 is moved to the bottom cammed end 67 of the slot 65 the pin is in contact with the top part of the rear arm 52, thereby preventing the hammer assembly from pivoting around shaft 49 even when the tab 54 would otherwise be permitted to drop into a notch on the wheel 56.

While a particular embodiment of the present invention has been shown and described, it will be apparent to those skilled in the art that various changes and modifications may be made without departing from the invention in its broader aspects, and it is, therefore, contemplated in the appended claims to cover all such changes and modifications as fall within the true spirit and scope of the present invention.

What is claimed as new and desired to be secured by Letters Patent of the United States is:

1. In a clock having a movement and chime sounding mechanism including a chime and a hammer assembly mounted for pivotal chime striking movement, said hammer assembly including a pivotal lever arm for supporting a chime clapper, said movement and mechanism being contained in a housing having a removable cover member for providing access to said movement and mechanism, the improvement consisting of a chime shutoff means comprising a pin carried on said cover member for preselected movement between first and second positions, said lever arm including a follower portion, a rotating wheel driven by said movement and positioned to be engaged by said follower portion, means biasing said lever arm into engagement with said wheel, said pin permitting said follower portion of said lever arm to be biased into generally continuous slideable engagement with said rotating wheel when in said first position and preventing pivotal movement of said hammer assembly by supporting said lever arm against said engagement when in said second position, said wheel having a notched portion comprising a generally radially extending drop surface for permitting abrupt displacement of said follower and limited pivotal movement of said hammer assembly.

2. In a clock as defined in claim 1, said cover member having a slot for slideably carrying said pin, said pin comprising a shouldered shaft and a knob, said shouldered shaft being insertable into said slot from one side of said cover and said knob being attached to said shouldered shaft from the opposite side of said cover thereby mounting said pin on said cover such that said pin is dissociated from said movement and said chime sounding mechanism upon removal of said cover.

3. In a clock as defined in claim 1, said slot being provided with generally arcuate cam surfaces for maintaining said pin in the preselected one of said first or second positions.

* * * * *